United States Patent [19]

Myers et al.

[11] Patent Number: 4,867,605

[45] Date of Patent: Sep. 19, 1989

[54] METHOD AND APPARATUS FOR RETRIEVING A RUNNING TOOL/GUIDEFRAME ASSEMBLY

[75] Inventors: Roderick J. Myers; Jorge H. Delgado, both of Houston, Tex.

[73] Assignee: Conoco Inc., Ponca City, Okla.

[21] Appl. No.: 183,945

[22] Filed: Apr. 20, 1988

[51] Int. Cl.[4] ..... E21B 7/128

[52] U.S. Cl. ..... 405/169; 405/188; 405/224; 166/341; 166/351; 166/345; 166/365; 285/18; 285/27

[58] Field of Search ..... 405/169, 170, 171, 224, 405/195, 188; 285/24, 27, 18; 166/338, 339, 340, 341, 351, 365, 345, 349

[56] References Cited

U.S. PATENT DOCUMENTS

| | | | |
|---|---|---|---|
| 3,513,909 | 5/1970 | Peterman | 166/340 X |
| 3,553,821 | 1/1971 | Postlewaite | 29/427 |
| 4,161,367 | 7/1979 | Cuiper et al. | 405/169 |
| 4,400,112 | 8/1983 | Castel et al. | 405/224 |
| 4,417,830 | 11/1983 | Shotbolt | 405/169 |
| 4,439,068 | 3/1984 | Pokladnik | 405/169 |
| 4,591,296 | 5/1986 | Henderson et al. | 405/195 |
| 4,708,524 | 11/1987 | Goris | 405/169 |

OTHER PUBLICATIONS

Skeels, H. B. and B. T. Landeis; "A New Deepwater Exploration Template Drilling System to Accomodate Early Production Tiebuck;" 0TC5320; pp. 265–269; 5/86.

*Primary Examiner*—Randolph A. Reese
*Assistant Examiner*—J. Russell McBee
*Attorney, Agent, or Firm*—Richard K. Thomson

[57] ABSTRACT

Method and apparatus for retrieving a running tool/-guideframe assembly without the use of winch wires. A portion or each guidepost assembly can be unlatched from the seafloor-mounted template to permit that portion to be retrieved using the guidewires. The unlatchable portion of the guidepost system is formed with a load support that engages and supports the running tool/guideframe assembly so that the assembly is retrieved concurrently with the unlatchable portions of the guidepost assemblies.

10 Claims, 2 Drawing Sheets

METHOD AND APPARATUS FOR RETRIEVING A RUNNING TOOL/GUIDEFRAME ASSEMBLY

BACKGROUND AND SUMMARY OF THE INVENTION

The present invention relates to a method and apparatus for retrieving a running tool/guideframe assembly from the ocean floor following riser installation without the need for winch wires.

In conventional offshore drilling techniques, a running tool/guideframe assembly is used to connect the production riser to the subsea wellhead. The running tool/guideframe assembly is attached to the leading end of the riser and is guided into position above the wellhead by lowering the running tool/guideframe assembly down previously installed guidelines that are attached to guideposts on the well template.

Winch wires are used in the conventional method to control the lowering of the assembly and then to retrieve the same following connection of the riser to the wellhead. The use of winch wires invariably leads to problems. A minimum of two winch wires are needed to maintain the running tool/guideframe assembly substantially horizontal to avoid binding on the guidelines. However, it is virtually impossible to let out two wires simultaneously at the identical rate. Hence, one or the other of the wires will wind up with slack in it which will invariably take a wrap around something it ought not be wrapped around. When this occurs, the lowering must be suspended and a diver or remotely operated vehicle sent down to try to untangle the winch wire. When drilling an offshore well, time is money, more money than almost anywhere else. When time has to be needlessly wasted in unproductive operations such as untangling winch wires, it tends to increase the frustration level of all concerned. The difficulty is exacerbated in deep water because of the additional cable lengths necessary.

The present invention is directed to a method and apparatus designed to overcome these problems by eliminating the need for winch wires. The guidepost system on the well template is modified so that a portion thereof may be unlatched. Further, the unlatched portion is provided with a load supporting means that can engage and lift the running tool/guideframe assembly. In this manner, the riser itself may be utilized to lower the running tool/guideframe assembly along the guidelines and then the assembly may be retrieved following unlatching of a portion of each of the guidepost assemblies and disconnection of the running tool from the riser by reeling in the guidelines.

Various other features, advantages and characteristics will become apparent after a reading of the following detailed description.

BRIEF DESCRIPTION OF THE DRAWING

The preferred embodiments of the present invention are depicted in FIGS. 2–4 of the Drawing in which like elements are indicated with like reference numerals and, in which.

DETAILED DESCRIPTION OF THE PREFERRED EMBODIMENTS

Figure 1:
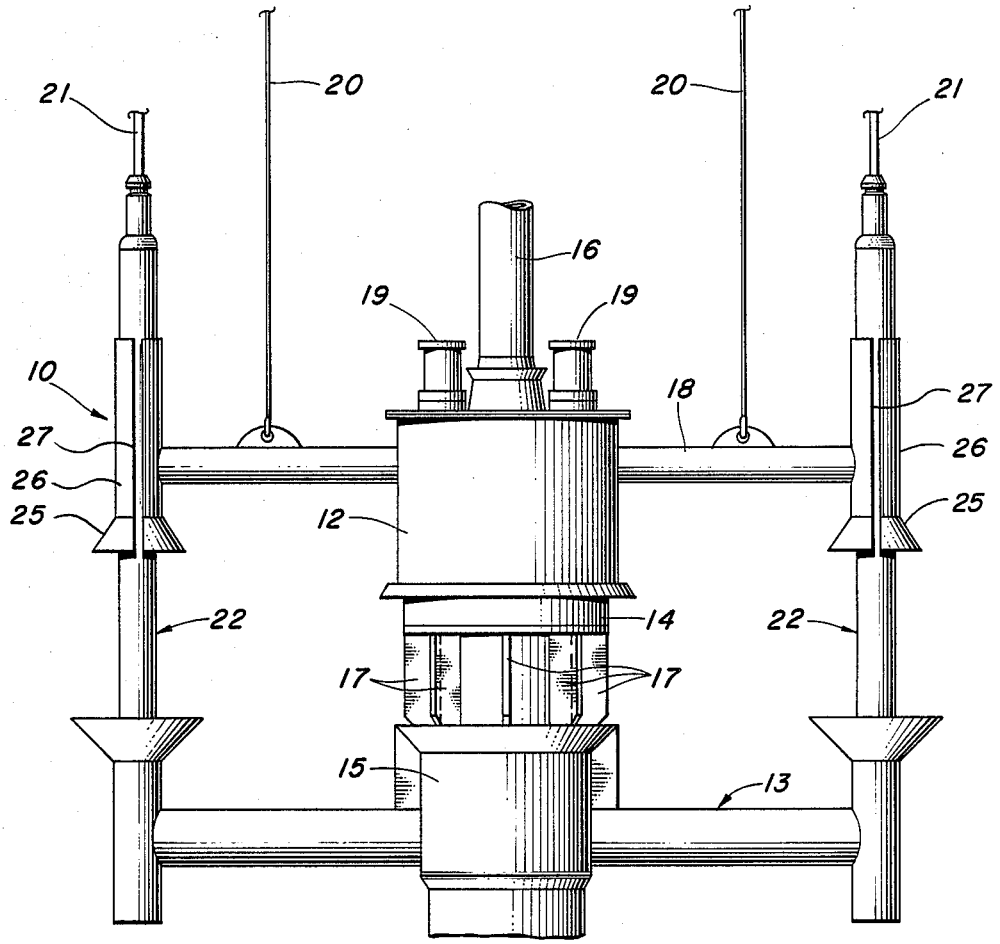
FIG. 1 PRIOR ART
FIG. 1 is a schematic side elevation of a running tool/guideframe assembly utilizing a prior art retrieval system over which the present invention is an improvement.

FIG. 1 depicts a running tool/guide frame assembly 10 which utilizes a prior art retrieval system employing winch wires 20. Running tool 12 is detachably interconnected to the riser connector 14 which is affixed to the lowermost end of riser 16. Riser connector 14 has a plurality of beveled plates 17 positioned about its periphery which reinforce the structure. A guide funnel (not shown) helps locate riser connector 14 with respect to wellhead 15. (The term shown in the figures as 15 is actually the template guide sleeve for casings, and the like. The actual wellhead is internal of 15 and cannot be seen). Wellhead 15 is seated in a housing provided for it in template 13. Guideframe 18 is fixedly attached to running tool 12 to complete assembly 10. Cylinders 19 (which may be hydraulically actuated) sit atop the running tool 12 and are activated to unlatch running tool 12 from riser connector 14. At least two (and as many as four) winch wires 20 are connected to the guideframe 18. Winch wires 20 are paid out off of reels (not shown) as the riser 16 is lowered with guideframe 18 traveling down guidelines 21. The winch wires 20 are then rewound to retrieve the assembly 10 when the connection of the riser 16 to wellhead 15 has been accomplished. Both the guide cylinders 26 and their entry end guide funnels 25 are slotted at 27 to permit insertion and removal of guidelines 21. Locking gates (not shown) are used to avoid undesired removal of guidelines 21 from cylinders 26.

As previously mentioned, the use of winch wires is undesirable because of problems related to their use. Even if the reels for the wires can be synchronized, one of the wires will, at some point, have an excessive length extending into the water, since it is virtually impossible to have each of the cables feed onto and off of its respective reel identically to each of the other reels so that the effective cable reel diameters are equal at all times. Then, per force, under the tenets of Murphy's Law, this slack in the cable will necessarily wrap around something. This wrapping can cause skewing and binding of the assembly 10 on guidelines 21 and threatens the possible breakage of the winch wire or damage to the assembly 10. Such a wire wrapping necessitates sending a diver or remotely operated vehicle (depending on depth), to dislodge the entanglement.

In order to avoid the problems associated with the usage of winch wires, the present invention (FIG. 2) employs (a) a releasable portion of the guidepost assembly 22, (b) an annular landing ring 24 (which becomes a load supporting means by engaging assembly 10 during retrieval) and (c) the guidelines 21, to retrieve the running tool/guideframe assembly 10. As with the conventional running tool/guideframe assembly 10 (FIG. 1), the guideframe assembly 18 includes four corner (two shown) guide cylinders 26 which are longitudinally slotted at 27 to receive guidelines 21, each cylinder 26 having a guide funnel 25 which assists in locating the assembly 10 with respect to guide post assembly 22. As will be discussed hereinafter, guide funnel 25 plays an important role in the method of retrieval in the present invention.

Figure 3:
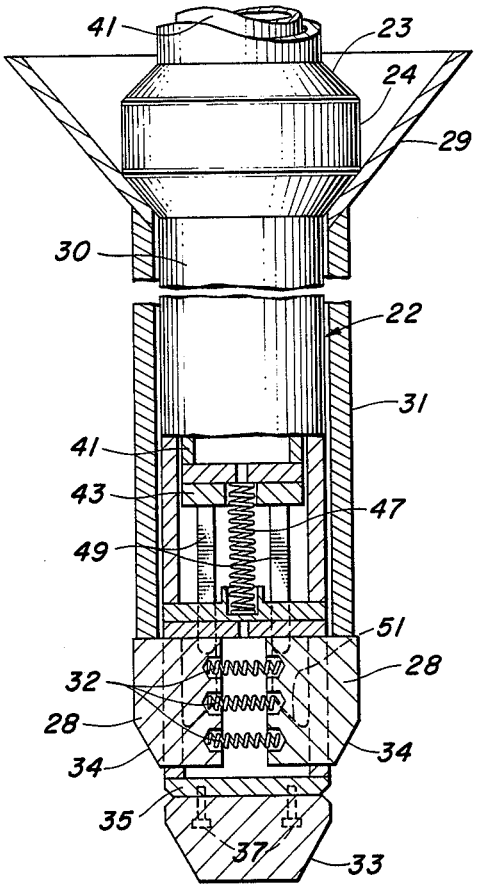
FIG. 3 is an enlarged side elevation in partial section detailing a first one of the two preferred release mechanisms.
Figure 2:
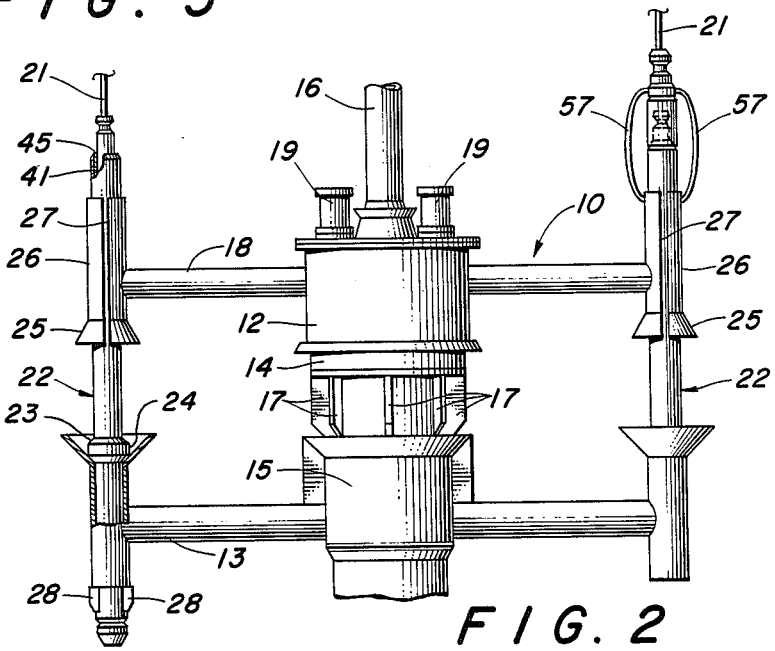
FIG. 2 is a schematic side elevation of the running tool/guideframe assembly of the present invention with portions broken away depicting two possible release mechanisms for a portion of the guidepost assembly.

In a first preferred embodiment depicted on the left-hand guidepost assembly 22 in FIG. 2 and in greater detail in FIG. 3, the releasable portion of the guidepost assembly 22 is the guidepost 30 itself. The specifics of the release mechanism are only of incidental importance to the invention and any releasable post design could be incorporated (subject to the inclusion of several key features) into the present retrieval apparatus. The specific design depicted in FIG. 3 was developed by FMC Corporation and disclosed in a paper entitled "A New Deepwater Exploration Template Drilling System to Accommodate Early Production Platform Tieback", presented in May 1986 to the Offshore Technology Conference in Houston, incorporated herein, in pertinent part, by reference.

In this first embodiment, shown in detail in FIG. 3, guidepost assembly 22 includes a guide line 21 attached to the top of post 30 and a pair of latching dogs 28 at the bottom that are biased outwardly by springs 32. The lower or leading ends 34 of dogs 28 are beveled to permit the latching dogs to be cammed inwardly as they come into contact with the guide funnel 29 of cylindrical post-receiving receptacle 31 on template 13. An annular landing ring 24 seats in funnel 29 and limits downward movement of guidepost assembly 22. Dogs 28 emerge from the lower end of post-receiving receptacle 31 and snap outwardly under the influence of biasing springs 32 locking the assembly 22 to the template 13.

A nose piece 33 is secured to leading end 35 of guidepost 30 by shear pins 37. An inner sleeve 41 extends from plunger 43 upwardly inside guidepost 30 and has an upper surface 45 engageable by a wireline tool (not shown), to depress plunger 43 against the upward bias of spring 47. The wireline tool may itself be hydraulically actuated after being lowered into contact with surface 45 or may simply have an extending sleeve which contacts surface 45 and be weighted to act under the influence of gravity.

When plunger 43 is actuated by sleeve 41, four fingers 49 (two shown) move downwardly in recesses in the upper portion of latching dogs 28, ultimately engaging beveled surfaces 51, thereby camming dogs 28 inwardly so that post assembly 22 may be withdrawn from receptacle 31.

In operation of this first embodiment, the riser 16 and riser connector 14 are run into position using the running tool/guide frame assembly 10. Guidelines 21 are inserted into slots 27 in cylindrical sleeves 26 at a point above the ocean's surface on the deck of an offshore platform (not shown) and the assembly 10 used to guide riser connector into position above wellhead 15. A guide funnel (not shown) centers the riser connector 14 with respect to the wellhead 15 to facilitate their interconnection.

Once the riser 16 and riser connector 14 are in place (provided there is no other need for guidelines 21), inner sleeve 41 will be actuated to its lower position by a wireline tool (not shown) retracting latching dogs 28, cylinders 19 will be operated to disengage the connection between riser connector 14 and running tool 12, and the guidelines 21 coiled at the surface to retrieve the guideposts 30 and the running tool/guideframe assembly 10. The load supporting means, which in this case is the landing ring 24 formed on guidepost 30, has a downwardly extending upper frustoconical surface 23 that is complementary to the frustoconical surface of funnel 25. As guidepost 30 is raised, it engages the guide funnel 25 and conveys the assembly to the surface without winch wires as the guidelines 21 are reeled in.

Should the latching dogs 28 fail to disengage as designed, the guidepost assembly 22 may, nonetheless, be retrieved by gripping the top of post 30 with a tool and exerting an upward force sufficient to fracture shear pins 37. When the nosepiece 33 breaks away, the latching dogs 28 and springs 32 also fall away permitting withdrawal of the guidepost assembly 22 from receptacle 31.

Figure 4:
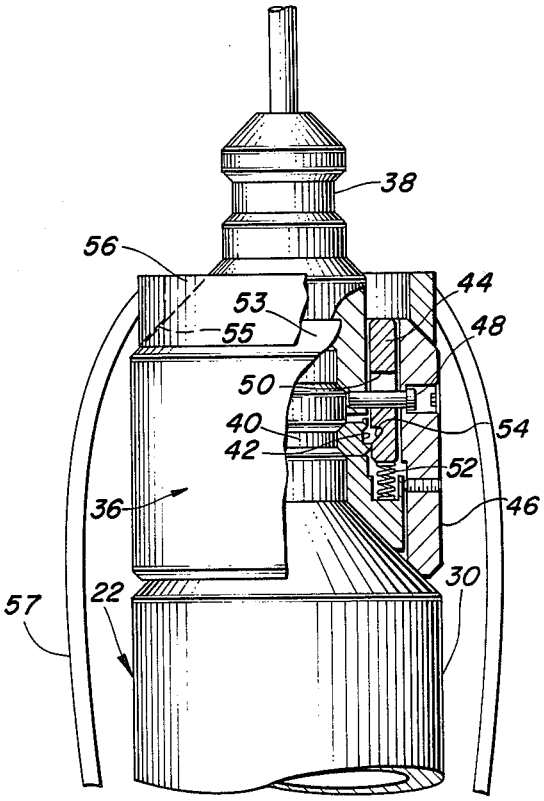
FIG. 4 is an enlarged side elevation in partial section detailing the second one of the two preferred release mechanisms.

A second preferred embodiment is depicted on the righthand side of FIG. 2 and shown in greater detail in FIG. 4. In this embodiment, the guidepost assembly 22 includes not only guideline 21 and guidepost 30, but also, a guidepost cap 36. Removable guidepost cap 36 may take any configuration desired that enables it to be locked on to the top of guidepost 30 and subsequently released to permit removal. It is preferred, however, that guidepost cap 36 itself include an upwardly extending center portion 38 that is similarly configured to the top of post 30. This enables conventional wireline equipment to be utilized and, in the event of guideline fraying, or the like, a new line may be run using a second cap 36 attached to center portion 38.

The top of guidepost 30 has an annular groove 40 formed therein (groove 40 taking the form of a broad-based v-groove in this embodiment). Groove 40 receives an annular split locking ring 42 which is biased outwardly to the non-engaged position. A slidable sleeve 44 can move vertically with respect to outer wall 46 of cap 36 and center portion 38 which are affixed to one another by screws 48 (one shown). Sleeve 44 has a plurality of vertically elongated slots 50 therein which receive screws 48 and still permit vertical movement of sleeve 44. A plurality (one shown) of springs 52 hold sleeve 44 in its upper engaged position where it biases split lock ring into groove 40 locking cap 36 on guidepost 30. A tool (not shown) may be inserted into the top of cap 36 along guideline 21 to engage and depress sleeve 44 against springs 52. Such a tool may be employed using a diver, wireline techniques or a remotely operated vehicle. When depressed downwardly, sleeve 44 has a contoured inner surface 54 that accommodates split locking ring 42 enabling ring 42 to assume its outwardly biased position allowing cap 36 to be removed from atop guidepost 30.

A guideline collar 56 has an inner diameter that readily receives and slides over guideline 21 but is insufficient to allow cap 36 to pass therethrough. Preferably the lower edge 55 of collar 56 is beveled to sit on the top surface 53 of cap 36. Each guideline collar 56 is interconnected to the top of its respective guide cylinder 26 by a plurality of (two shown) straps 57. Straps 57 are of sufficient length and rigidity to enable proper connections between riser connector 14 and wellhead 15 without the weight of the running tool/guide frame assembly 10 hanging upon guideline cap 36.

In operation of this embodiment, the running tool/guideframe assembly 10 is mounted and lowered upon guidelines 21 as in the case of the first embodiment. Guideline collar 56 may also be slotted to receive guideline 21 with a slotted rotatable locking disc (not shown) locking collar 56 onto guideline 21, as is typically used with guide cylinders 26. This obviates the need for a free end of guidewires 21, which is difficult to provide while maintaining tension.

When riser connector 14 is securely attached to wellhead 15 and no further equipment need be lowered using guidelines 21, cylinders 19 uncouple running tool 12 from connector 14, a tool is used to slide sleeve 44 downwardly against the action of biasing springs 52 removing the inward biasing force on split locking ring 42. Upward force applied on cap 36 by retrieving guidelines 21 pulls cap 36 off the top of guidepost 30 bringing upper beveled surface 53 of cap 36 into contact with the beveled surface 55 of collar 56. The mating beveled surfaces keep the collar 56 centered relative to cap 36 as the running tool/guide frame assembly is retrieved to the surface by coiling guidelines 21.

The present invention eliminates the need to use troublesome winch wires to accomplish retrieval of the running tool/guide frame assembly 10 following connection of the riser connector 14 with wellhead 15. This greatly simplifies the installation and recovery of assembly 10.

Various changes, alternatives and modifications will become apparent following a reading of the foregoing specification. It is intended that any such changes, alternatives and modifications as come within the scope of the appended claims be considered part of the claimed invention.

We claim:

1. A method of interconnecting a subsea wellhead positioned on an ocean floor with a deck of an above-surface platform said method comprising:

(a) attaching a plurality of guidepost assemblies to a well template, said well template being secured to a portion of said ocean floor in such a manner so as to position at least some of said plurality of guidepost assemblies adjacent to and surrounding said subsea wellhead, each one of said plurality of guidepost assemblies including
  (i) a guidepost
  (ii) a guideline which extends from said platform deck to said guidepost, and
  (iii) a releasable element of said guidepost assembly;

(b) securing a running tool/guideframe assembly to a riser connector which is itself attached to a leading end of a riser string;

(c) lowering said riser connector into position above said wellhead by engaging said running tool/guideframe assembly with said at least some of said plurality of guidepost assemblies;

(d) latching said riser connector to said subsea wellhead;

(e) disconnecting said releasable element of each of said at least some of said plurality of guidepost assemblies;

(f) permitting a portion of each of said at least some of said plurality of guidepost assemblies to engage and lift said running tool/guideframe assembly;

(g) using said guidelines to retrieve said running tool/guideframe assembly by virtue of said engagement between each of said portions of at least some of said plurality of guidepost assemblies and said running tool/guideframe assembly.

2. Apparatus for interconnecting a subsea wellhead positioned at a particular location on an ocean floor with a deck of an above-surface platform, said apparatus comprising:

(a) a plurality of guidepost assemblies affixed to a well template which is mounted on the ocean floor, each of said plurality of guidepost assemblies including a guideline extending from said platform deck to one of a plurality of guideposts thereby defining a plurality of guidelines, said plurality of guideposts being positioned adjacent to and at least partially surrounding said subsea wellhead;

(b) a riser string;

(c) a riser connector attached to a leading end of said riser string;

(d) a running tool/guideframe assembly connected to said riser connector by detachable connecting means, said running tool/guideframe assembly including a plurality of cylindrical guide tubes which encircle said plurality of guidelines to permit controlled descent of said riser connector to a point adjacent said subsea wellhead;

(e) means to latch said riser connector into engagement with said subsea wellhead;

(f) releasable connecting means enabling a portion of each of said plurality of guidepost assemblies to be detached from said well template thereby defining a detachable portion;

(g) load supporting means affixed to said detachable portion of each of said plurality of said guidepost assemblies said load supporting means engaging an element of said running tool/guideframe assembly after said means to latch said riser connector to said subsea wellhead is engaged, after said detachable portion is detached from said well template and after said detachable connecting means disconnects said running tool/guideframe assembly from said riser connector whereby said running tool/guideframe assembly is hoisted to the surface by retrieving said plurality of guidelines.

3. The apparatus of claim 2 wherein each of said plurality of cylindrical guide tubes further comprises a downwardly and outwardly extending guide funnel which assists in positioning said running tool/guideframe assembly.

4. The apparatus of claim 3 wherein said guide funnel comprises said element of the running tool/guideframe assembly engaged by said load supporting means.

5. The apparatus of claim 3 wherein said portion of each of said plurality of guidepost assemblies which is detached by said releasable connecting means is a release mechanism positioned on a lower region of said guidepost itself.

6. The apparatus of claim 5 wherein said load supporting means comprises a shoulder portion formed on each of said guideposts, said shoulder portion having an upper beveled surface which is complementarily received in said guide funnel.

7. The apparatus of claim 2 wherein said portion detached by the releasable connector means comprises a guidepost cap which is releasably attached to a top portion of at least some of said plurality of guideposts.

8. The apparatus of claim 7 wherein said load supporting means comprises an upper surface of said guidepost cap.

9. The apparatus of claim 8 wherein said elements which are engaged comprise a guideline collar positioned above said guidepost cap, said guideline collar being interconnected to a remaining portion of said running tool/guideframe assembly by straps.

10. The apparatus of claim 9 wherein said guideline collar has an inner diameter sufficient to permit the free passage of said guideline therethrough but small enough to ensure that a lower surface of said guideline collar engages the upper surface of said guidepost cap.

* * * * *